US009314083B2

(12) United States Patent
Shaul

(10) Patent No.: US 9,314,083 B2
(45) Date of Patent: Apr. 19, 2016

(54) FINGERNAIL CLEANING APPARATUS AND METHOD

(71) Applicant: Shaul Shaul, Azor (IL)

(72) Inventor: Shaul Shaul, Azor (IL)

( * ) Notice: Subject to any disclaimer, the term of this patent is extended or adjusted under 35 U.S.C. 154(b) by 0 days.

(21) Appl. No.: 14/488,465

(22) Filed: Sep. 17, 2014

(65) Prior Publication Data

US 2015/0114417 A1 Apr. 30, 2015

(30) Foreign Application Priority Data

Oct. 31, 2013 (IL) ..... 229189

(51) Int. Cl.

| | |
|---|---|
| ***A45D 29/18*** | (2006.01) |
| ***A45D 29/17*** | (2006.01) |
| ***A45D 29/14*** | (2006.01) |
| ***A45D 29/22*** | (2006.01) |
| ***A45D 29/00*** | (2006.01) |
| ***A45D 34/04*** | (2006.01) |

(52) U.S. Cl.

CPC ..... *A45D 29/17* (2013.01); *A45D 29/007* (2013.01); *A45D 29/14* (2013.01); *A45D 29/22* (2013.01); *A45D 34/04* (2013.01)

(58) Field of Classification Search

CPC ..... A45D 29/00; A45D 29/20; A45D 29/17; A45D 29/007; A45D 29/22; A45D 2200/056

See application file for complete search history.

(56) References Cited

U.S. PATENT DOCUMENTS

| | | | | |
|---|---|---|---|---|
| 4,137,929 | A | 2/1979 | Grossman | |
| 4,523,580 | A * | 6/1985 | Tureaud | 601/104 |
| 6,286,517 | B1 * | 9/2001 | Weber et al. | 132/73 |
| 2014/0325728 | A1 * | 11/2014 | Albera | 2/16 |

FOREIGN PATENT DOCUMENTS

CN 201543622 * 8/2010

OTHER PUBLICATIONS http://en.wikipedia.org/wiki/Nail_polish (attached).
http://en.wikipedia.org/wiki/Abrasive_blasting (attached).

* cited by examiner

*Primary Examiner* — Rachel Steitz
(74) *Attorney, Agent, or Firm* — Daniel J. Swirsky; AlphaPatent Associates Ltd.

(57) ABSTRACT

A fingernail cleaning apparatus (10), comprising: a chamber (60) into which fingernails (44) of a user are placed; a compressor (22), for generating a jet (42) of abrasive powder (40); and a first nozzle (30), for directing the abrasive powder jet (42) onto a front side of the fingernails (44) when placed in the chamber (60); thereby allowing cleaning the front side of the fingernails (44) and/or roughening the front side of the fingernails (44) by the abrasive powder (40) as a preceding step for applying nail polish.

9 Claims, 5 Drawing Sheets

FINGERNAIL CLEANING APPARATUS AND METHOD

TECHNICAL FIELD

The present invention relates to the field of nail polishing. More particularly, the invention relates to a method and apparatus for cleaning the nails prior to polishing

BACKGROUND ART

"Nail polish is a lacquer applied to human finger to decorate and protect the nail plate. Today's nail polish is a refined version similar to the paint on vehicles. However, its formula has been revised repeatedly to prevent the cracking or flaking that occurs with the natural movement of the nail.

Nail polish is removed with nail polish remover or nail pads, which is an organic solvent, but may also include oils, scents and coloring. Nail polish remover packages may include individual felt pads soaked in remover, a bottle of liquid remover that can be used with a cotton ball or cotton pad, and even containers filled with foam that can be used by inserting a finger into the container and twisting until the polish comes off.

The most common type of nail polish remover contains the volatile organic compound acetone. It is powerful and effective."(from http://en.wikipedia.org/wiki/Nail_polish)

However, the polish removers are disadvantaged in that the acetone is harsh on skin and nails, which makes them more brittle, and is toxic.

It is an object of the present invention to provide a method and apparatus for cleaning the nails, and in particular, removing nail polish, without chemical compounds.

It is a further object of the present invention to provide a method and apparatus for conveniently polishing fingernails, including replacing a present layer.

It is an object of the present invention to provide a solution to the above-mentioned and other problems of the prior art.

Other objects and advantages of the invention will become apparent as the description proceeds.

SUMMARY OF THE INVENTION

In one aspect, the present invention is directed to a fingernail cleaning apparatus (10), comprising:

- a chamber (60) into which fingernails (44) of a user are placed;
- a compressor (22), for generating a jet (42) of abrasive powder (40); and
- a first nozzle (30), for directing the abrasive powder jet (42) onto fingernails (44) when placed in the chamber (60);
- thereby allowing cleaning the fingernails (44) by the abrasive powder jet (42) without scattering the abrasive powder (40).

The fingernail cleaning apparatus (10) may further comprise:

- a guiding structure (18, 38), for guiding the first nozzle (30), for performing the directing of the abrasive powder jet (42) onto the fingernails (44),
- thereby accurately blowing the abrasive powder (42) onto the fingernails (44) only.

The guiding structure (18, 38) may comprise:

- a track (18) for guiding the first nozzle (30) therealong.

The guiding structure (18, 38) may comprise:

- a rigid stationary template (38) of a hand (26), for determining an accurate location of each fingernail (44).

The guiding structure (18, 38) may further comprise:

- a rigid stationary template (38) of a hand (26), for determining an accurate location of each fingernail (44), wherein the rigid template (38) physically corresponds to the track (18).

The physical correspondence of the rigid template (38) to the track (18) may comprise physical subsidiary tracks (18A, 18E) of the track (18), each being disposed above one subsidiary template (38A, 38E) of the template (38).

The fingernail cleaning apparatus (10) may further comprise:

- a glove (38), for exposing the fingernails (44) only, thereby protecting the user from the abrasive powder (42).

The fingernail cleaning apparatus (10) may further comprise:

- a liquid dispenser (50), for dispensing liquid (52) through the first nozzle (30),
- thereby accurately dispensing the liquid (52) on the fingernail (44).

The fingernail cleaning apparatus (10) may further comprise:

- a liquid dispenser (50), for dispensing liquid (52); and
- a second nozzle (54), for transferring the dispensed liquid (52) therethrough,
- thereby accurately dispensing the liquid (52) on the fingernails (44).

The finger nail cleaning apparatus (10) may further comprise a closed course for the abrasive powder (42), thereby allowing re-using of the abrasive powder (42).

In another aspect, the present invention is directed to a finger nail cleaning method, comprising the steps of:

- generating a jet (42) of abrasive powder (40); and
- guiding a nozzle (30), for directing the abrasive powder jet (42) from
- the first nozzle (30) onto the finger nails (44),
- thereby accurately blowing the abrasive powder (42) onto the finger nails (44).

The method may further comprise the steps of:

- guiding (18, 38) a nozzle (30, 54) to the finger nails of the user; and
- dispensing liquid (52) from the second nozzle (54) onto the finger nails, for polishing thereof.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF DRAWINGS

Preferred embodiments, features, aspects and advantages of the present invention are described herein in conjunction with the following drawings.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting. For the sake of brevity, some well-known features, methods, systems, procedures, components, circuits, and so on, are not described in detail.

The term "abrasive powder" refers herein to small particles of a material, often a mineral, such as alumina, used to shape or finish a workpiece through rubbing. The workpiece for the present invention is the fingernail.

The term "abrasive blasting" or "sand blasting" refers herein to the operation of forcibly propelling a stream of an abrasive powder against a surface under high pressure to smooth a rough surface, roughen a smooth surface, shape a surface, or remove surface contaminants. A pressurized fluid, typically air, commonly is used to propel the abrasive material.

Figure 1:
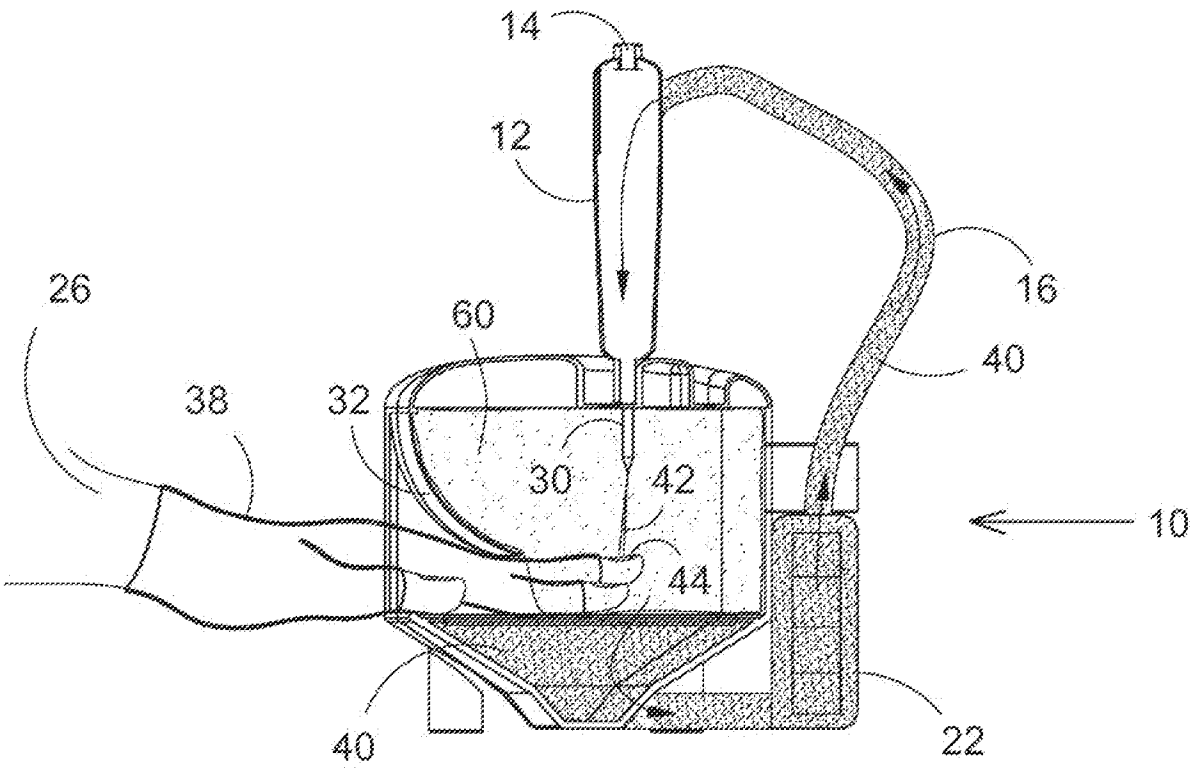
FIG. 1 is a cross-section view of a fingernail cleaning apparatus, according to one embodiment of the present invention.

FIG. 1 is a cross-section view of a fingernail cleaning apparatus, according to one embodiment of the present invention.

A fingernail cleaning apparatus 10 according to the present invention cleans the fingernails 44 by abrasive blasting. A compressor 22 blows a jet 42 of abrasive powder 40 from a nozzle 30 towards a fingernail 44.

Compressor 22 may blow abrasive powder 40 either by pressure blast equipment or by suction (siphon) blast equipment using the Venturi principle (both described in http://en.wikipedia.org/wiki/Abrasive_blasting).

The abrasive powder 40, after rubbing fingernails 44 by jet 42, may fall down through perforations disposed below fingernails 44, for being re-used by a closed course, as depicted by the arrows.

The act of blowing a jet 42 of abrasive powder 40 onto fingernails 44 is a "clean" process, as the abrasive powder 40 does not scatter, as the process is conducted within a closed chamber 60. The opening of the chamber, through which the hand 26 is inserted, is closed by hand 26 and a springy cover 32 pressing it.

Figure 2:
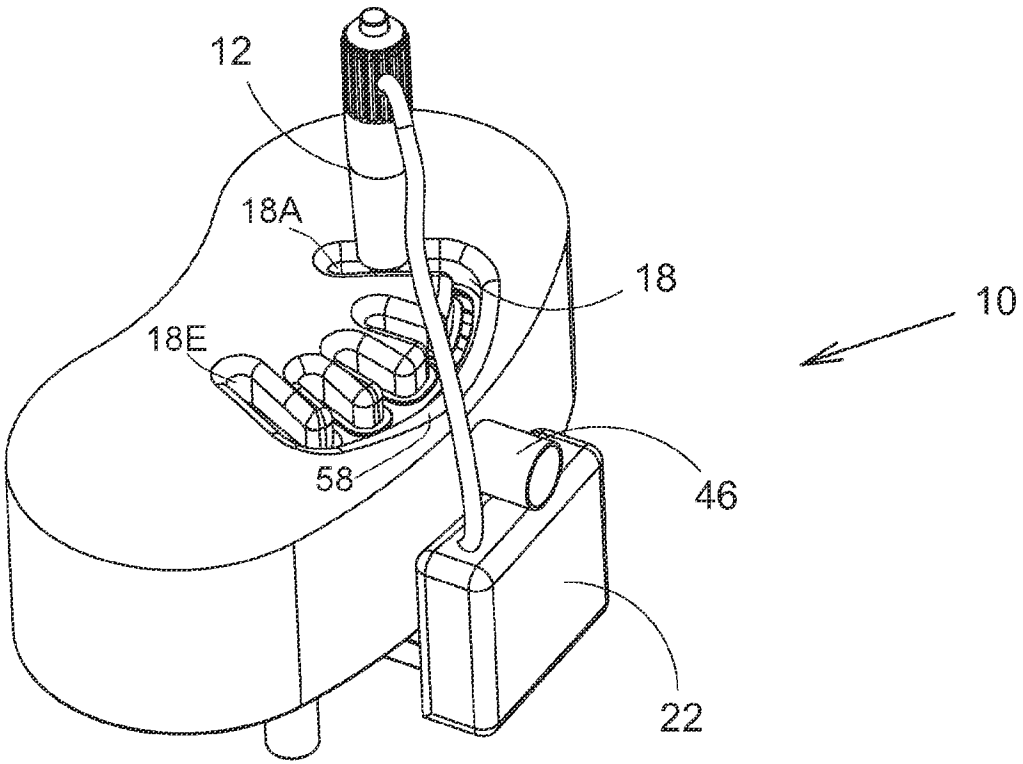
FIG. 2 is a top view of the fingernail cleaning apparatus of FIG. 1.

FIG. 2 is a top view of the fingernail cleaning apparatus of FIG. 1.

Fingernail cleaning apparatus 10 includes a guiding structure for limiting the available locations of nozzle 30, for ensuring that nozzle 30 blows abrasive powder jet 42 on the fingernails 44 only.

According to one embodiment, the guiding structure includes a track 18, for guiding nozzle 30, such that nozzle 30 is limited to being moved therealong only. Track 18 includes subsidiary tracks, namely 18A, 18E, and others, each for allowing nozzle 30 to be located against one finger; and a main sub-track 58, for guiding nozzle 30 from one subsidiary (18A, 18E) to another. The guiding may be manual or motorized.

According to one embodiment, compressor 22 is enabled only upon locating nozzle 30 at the end of a subsidiary track (18A, 18E).

Figure 3:
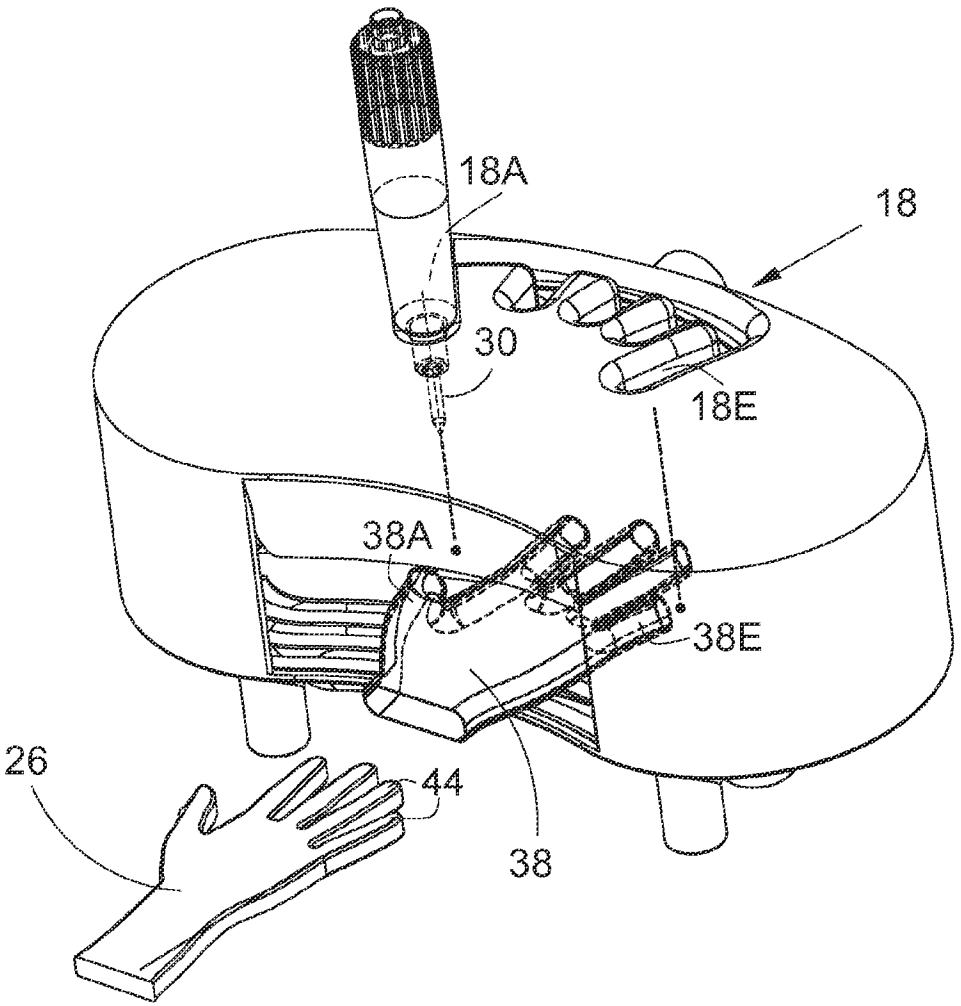
FIG. 3 is a front perspective cross-section view of the fingernail cleaning apparatus of FIG. 1.

FIG. 3 is a front perspective cross-section view of the fingernail cleaning apparatus of FIG. 1.

In order to ensure that track 18 indeed guides nozzle 30 to the fingernails 44 only, the guiding structure further limits fingernails 44 to pre-determined locations, by a stationary rigid template 38, into which the user inserts the hand 26 thereof. Fingers template 38 includes subsidiary templates, namely 38A, 38E and others, each for inserting one finger therewithin, such that the fingernail 44 protrudes out. Template 38 is shaped like a glove having short finger covers.

In addition, template 38 protects the fingers of the user.

Figure 4:
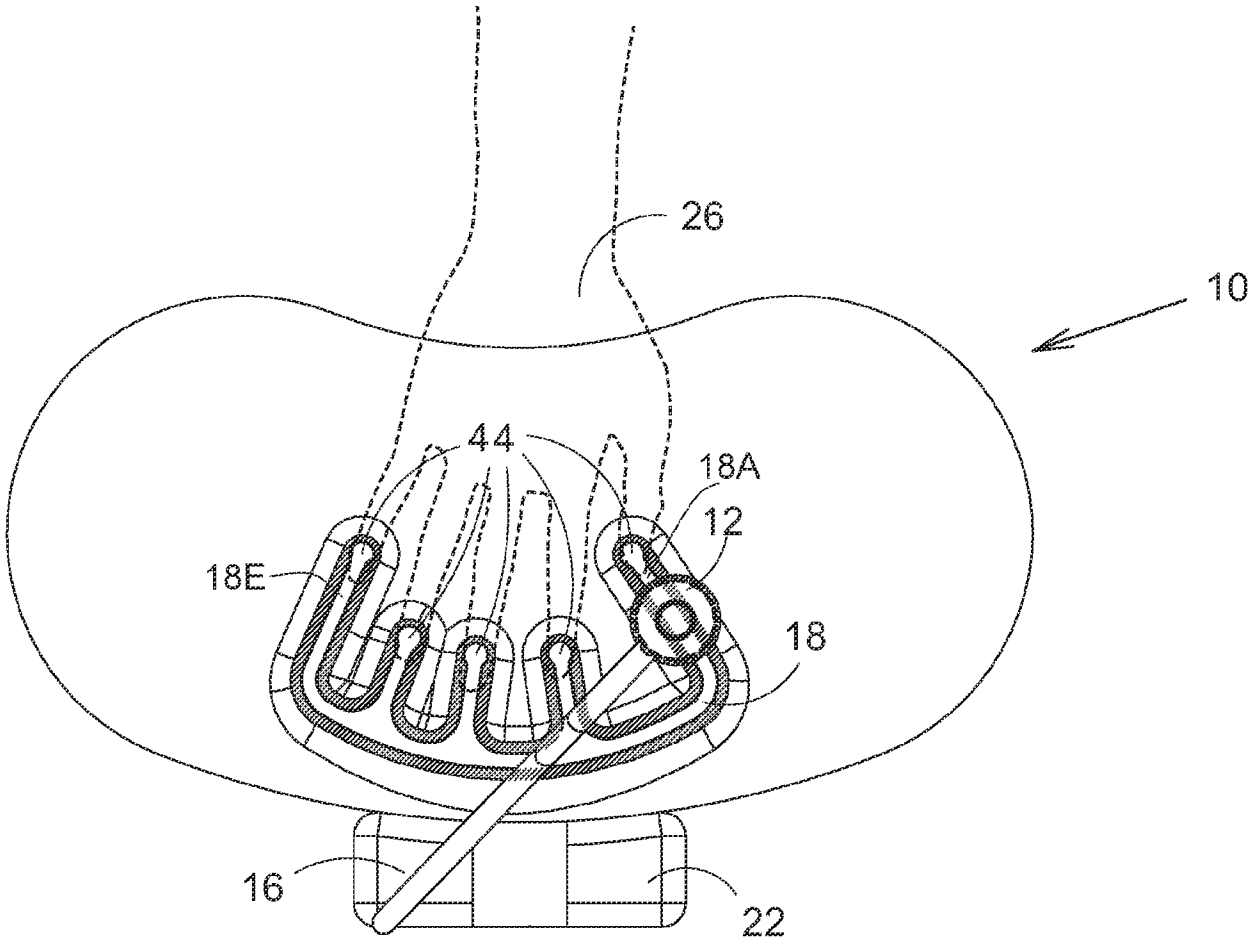
FIG. 4 is a top perspective cross-section view of the fingernail cleaning apparatus of FIG. 1.

FIG. 4 is a top perspective cross-section view of the fingernail cleaning apparatus of FIG. 1.

Track 18 is shaped and disposed against fingers template 38, for providing correspondence therebetween, in that each fingernail 44 is disposed under an end of a subsidiary track (18A, 18E).

Figure 5:
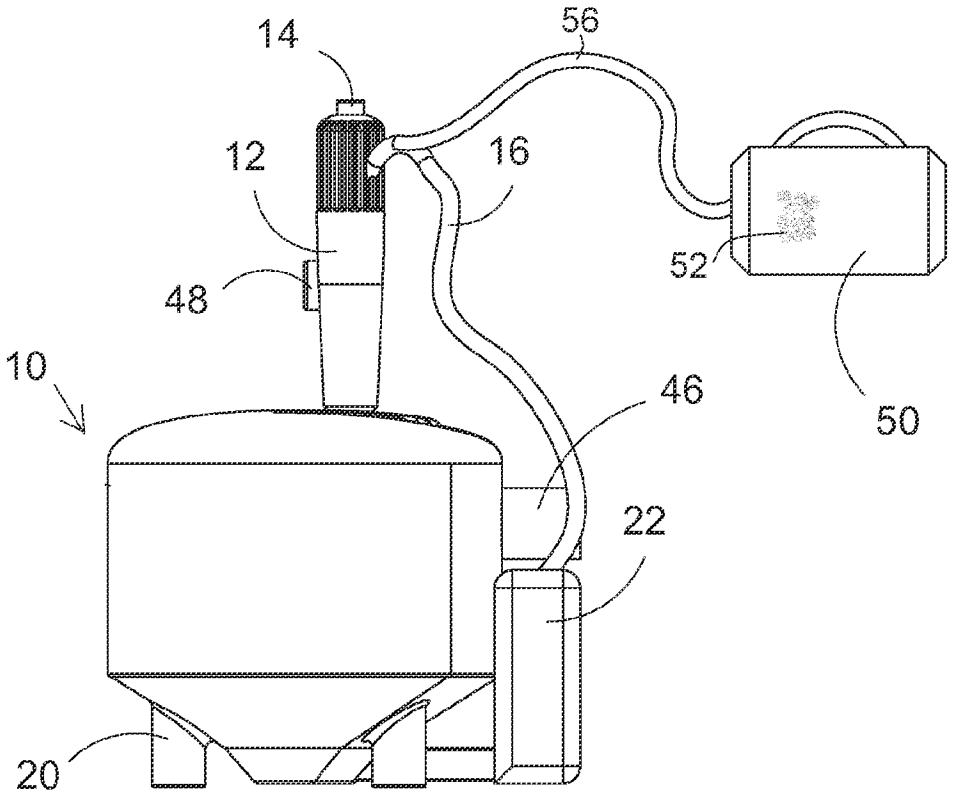
FIG. 5 depicts the fingernail cleaning apparatus of FIG. 1, also including a liquid dispenser.

FIG. 5 depicts the fingernail cleaning apparatus of FIG. 1, including also a liquid dispenser.

Fingernail cleaning apparatus 10 may further include a lacquer dispenser or any other liquid dispenser, for accurately dispensing lacquer 52 or any other liquid on the fingernails.

Whereas compressor 22 is connected to nozzle 30 through a pipe 16, a liquid dispenser 50, which may constitute a second compressor 50 or a manual pump, may dispense, through a second pipe 56, nail lacquer 52 or any other liquid or nail polish to nozzle 30. Nozzle 30, moving within track 18, may accurately dispense liquid 52 onto the fingernails.

According to another embodiment, a handle 12 of nozzle 30 may be removed from track 18, for inserting a second nozzle 54 thereinto.

In the figures and/or description herein, the following reference numerals (Reference Signs List) have been mentioned:

- numeral 10 denotes a fingernail cleaning apparatus according to one embodiment of the present invention;
- numeral 12 denotes a handle of the nozzle;
- numeral 14 denotes a switch for turning on the compressor;
- numeral 16 denotes a pipe;
- numeral 18 denotes a track;
- numerals 18A and 18E denote subsidiary tracks, each corresponding to one finger;
- numeral 20 denotes a leg, for supporting the funnel-shaped chamber; the chamber is shaped so for collecting the abrasive powder falling through perforations to the bottom of the chamber, below the hand of the user, for re-use;
- numeral 22 denotes a compressor for blowing an abrasive powder;
- numeral 26 denotes a hand of the user;
- numeral 30 denotes a nozzle, for blowing the abrasive powder jet;
- numeral 32 denotes a supporting element for the hand, which may also function as a side cover for preventing exit of the abrasive powder;
- numeral 38 denotes a glove having short sleeves for the fingers, for exposing the fingernails and for protecting the other regions of the hand; according to one embodiment, the glove is rigid and stationary, for limiting each fingernail to a limited location, for ensuring the accurate location of the abrasive blasting and of the lacquer/polish dispensing;
- numeral denotes an abrasive powder, such as sand, alumina or other;
- numeral 42 denotes a jet of the abrasive powder;
- numeral 44 denotes a fingernail;
- numeral 48 denotes a switch for turning on the liquid dispenser;
- numeral 50 denotes a liquid dispenser;
- numeral 52 denotes a nail polish or other liquid;
- numeral 54 denotes another nozzle;
- numeral 56 denotes another pipe;
- numeral 58 denotes a main sub-track of the track, for guiding the nozzle; and numeral 60 denotes a chamber.

In the description herein, the following references have been mentioned:

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof These reference numbers should not be interpreted as limiting the claims in any form.

The invention claimed is:

1. A fingernail cleaning apparatus (10), comprising:

a chamber (60) into which fingernails (44) of a user are placed;

a compressor (22), for generating a jet (42) of abrasive powder (40); and a first nozzle (30), for directing said abrasive powder jet (42) onto a front side of the fingernails (44) when placed in said chamber (60); and means for protecting tissues of the user being adjacent to the fingernails (44) from said jet (42) of abrasive powder (40)

a liquid dispenser (50), for dispensing liquid (52), through said first nozzle (30) or through a second nozzle (54), thereby allowing cleaning the front side of the fingernails (44) and/or roughening the front side of the fingernails (44) by the abrasive powder (40) as a preceding step for applying nail polish, and thereby dispensing the liquid (52) on the fingernails (44).

2. A fingernail cleaning apparatus (10) according to claim 1, wherein said means for protecting the tissues of the user comprises:

a guiding structure (18, 38), for guiding said first nozzle (30), for performing said directing of said abrasive powder jet (42) onto the fingernails (44), thereby blowing the abrasive powder (42) onto the fingernails (44) only.

3. A fingernail cleaning apparatus (10) according to claim 2, wherein said guiding structure (18, 38) comprises:

a track (18) for guiding said first nozzle (30) therealong.

4. A fingernail cleaning apparatus (10) according to claim 2, wherein said guiding structure (18, 38) comprises:

a rigid stationary template (38) of a hand (26), for determining a location of each fingernail (44).

5. A fingernail cleaning apparatus (10) according to claim 3, wherein said guiding structure (18, 38) further comprises:

a rigid stationary template (38) of a hand (26), for determining a location of each fingernail (44), wherein said rigid template (38) physically corresponds to said track (18).

6. A fingernail cleaning apparatus (10) according to claim 5, wherein said physical correspondence of said rigid template (38) to said track (18) comprises physical subsidiary tracks (18A, 18E) of said track (18), each being disposed above one subsidiary template (38A, 38E) of said template (38).

7. A fingernail cleaning apparatus (10) according to claim 1, wherein said means for protecting the tissues of the user comprises:

a glove (38), for exposing the fingernails (44) only, thereby protecting the user from the abrasive powder (42).

8. A fingernail cleaning apparatus (10) according to claim 1, further comprising a closed course for the abrasive powder (42), thereby allowing re-using the abrasive powder (42).

9. A fingernail cleaning method, comprising the steps of:

generating a jet (42) of abrasive powder (40); and guiding (18, 38) a first nozzle (30), for directing the abrasive powder jet (42) from said first nozzle (30) onto a front side of fingernails (44) while protecting tissues adjacent to said front side of fingernails (44), guiding a second nozzle (30, 54) to the front side of the fingernails of the user; and dispensing liquid (52) from said second nozzle (54) onto said front side of the fingernails, for polishing thereof, thereby blowing the abrasive powder (42) onto the front side of the fingernails (44).

* * * * *